US005873508A

United States Patent [19]

MacVicar et al.

[11] Patent Number: 5,873,508

[45] Date of Patent: Feb. 23, 1999

[54] INTERNAL COMBUSTION POWERED TOOL

[75] Inventors: Robert T. MacVicar, Downers Grove; J. Oscar Aparicio, Aurora; Tony J. Walter; John P. Walter, both of Cary; Anton J. Walter, Algonquin, all of Ill.

[73] Assignee: Applied Tool Development Corporation, Elgin, Ill.

[21] Appl. No.: 920,160

[22] Filed: Aug. 26, 1997

Related U.S. Application Data

[62] Division of Ser. No. 447,787, May 23, 1995, Pat. No. 5,752,643.

[51] Int. Cl.[6] ..... B25C 1/08

[52] U.S. Cl. ..... 227/10; 227/9; 123/465 C

[58] Field of Search ..... 27/9, 10, 8, 11, 27/130; 123/465 C

[56] References Cited

U.S. PATENT DOCUMENTS

| | | |
|---|---|---|
| 3,042,008 | 7/1962 | Liesse . |
| 3,150,488 | 9/1964 | Haley . |
| 3,202,055 | 8/1965 | Butler et al. . |
| 3,645,091 | 2/1972 | Ivanov et al. . |
| 3,858,781 | 1/1975 | Obergfell et al. . |
| 3,967,771 | 7/1976 | Smith . |
| 4,007,803 | 2/1977 | Airhart . |
| 4,060,188 | 11/1977 | Monson . |
| 4,073,362 | 2/1978 | Airhart . |
| 4,260,092 | 4/1981 | Austin . |
| 4,279,341 | 7/1981 | Pleickhardt . |
| 4,286,496 | 9/1981 | Harris . |
| 4,331,277 | 5/1982 | Green . |
| 4,401,251 | 8/1983 | Nikolich . |
| 4,403,722 | 9/1983 | Nikolich . |
| 4,430,035 | 2/1984 | Rodseth . |
| 4,483,280 | 11/1984 | Nikolich . |

(List continued on next page.)

FOREIGN PATENT DOCUMENTS

| | | |
|---|---|---|
| 2552106 | 5/1976 | Germany . |
| 52-3772 | 1/1977 | Japan . |
| 53-34179 | 3/1978 | Japan . |
| 53-115980 | 10/1978 | Japan . |
| 53-115981 | 10/1978 | Japan . |
| 1-280883 | 11/1990 | Japan . |
| 2-212757 | 11/1990 | Japan . |

OTHER PUBLICATIONS

SAE, Highway Vehicle Recommended Practice, Gasoline Fuel Injector, Nov., 1989.

"Effects of Mixture Formation of Fuel Injection Systems in Gasoline Engine", Society of Automotive Engineers, Inc., Warrendale, PN, 1989.

"Mixture Formation of Fuel Injection Systems in Gasoline Engines", Society of Automotive Engineers, Inc., Warrendale, PN, 1988.

(List continued on next page.)

*Primary Examiner*—Scott A. Smith

*Attorney, Agent, or Firm*—Cook, McFarron & Manzo, Ltd.

[57] ABSTRACT

An internal combustion powered tool, such as a nail or fastener driver, and a control system, spark source, and rotary valve for use in an internal combustion powered tool are disclosed. The tool may include, for example, a cylinder and a piston reciprocally moveable within the cylinder. A combustion chamber is defined at one end of the cylinder, with the piston comprising a portion of one end of the combustion chamber. The tool may have a fastener driver associated with the piston, and a magazine for feeding fasteners into registration with the driver. A fuel flow passageway extends between a fuel source and the combustion chamber, and a metering valve controls the flow of fuel to the combustion chamber. A spark source within the combustion chamber is provided for igniting the fuel, and an intake and exhaust valve that includes a pair of diametrically opposed apertures is provided. At least one fan external to the combustion chamber induces an intake of fresh air into the combustion chamber through one of the apertures and an exhaust of combustion products from the combustion chamber through the other aperture. Additional and alternative details and features are described in the disclosure.

9 Claims, 11 Drawing Sheets

U.S. PATENT DOCUMENTS

| | | |
|---|---|---|
| 4,483,473 | 11/1984 | Wagdy . |
| 4,483,474 | 11/1984 | Nikolich . |
| 4,522,162 | 6/1985 | Nikolich . |
| 4,597,517 | 7/1986 | Wagdy . |
| 4,712,379 | 12/1987 | Adams et al. . |
| 4,721,240 | 1/1988 | Cotta . |
| 4,739,915 | 4/1988 | Cotta . |
| 4,773,581 | 9/1988 | Ohtsu et al. . |
| 4,913,331 | 4/1990 | Utsumi et al. . |
| 4,932,480 | 6/1990 | Golsch . |
| 4,942,996 | 7/1990 | Wolfberg et al. . |
| 4,975,008 | 12/1990 | Wagner . |
| 4,979,858 | 12/1990 | Van Allman et al. . |
| 5,069,340 | 12/1991 | Ernst et al. . |
| 5,090,606 | 2/1992 | Torii et al. . |
| 5,133,329 | 7/1992 | Rodseth et al. . |
| 5,191,209 | 3/1993 | Rodseth et al. . |
| 5,193,729 | 3/1993 | Dewey et al. . |
| 5,197,646 | 3/1993 | Nikolich . |
| 5,197,647 | 3/1993 | Howell . |
| 5,199,506 | 4/1993 | Dewey et al. . |
| 5,199,625 | 4/1993 | Dewey et al. . |
| 5,213,247 | 5/1993 | Gschwend et al. . |
| 5,261,587 | 11/1993 | Robinson . |
| 5,263,439 | 11/1993 | Doherty et al. . |
| 5,263,626 | 11/1993 | Howard et al. . |
| 5,302,068 | 4/1994 | Janusz et al. . |
| 5,320,268 | 6/1994 | Shkolnikov et al. . |
| 5,415,136 | 5/1995 | Doherty et al. . |
| 5,437,404 | 8/1995 | Shkolnikov . |
| 5,443,345 | 8/1995 | Gupta . |
| 5,452,835 | 9/1995 | Shkolnikov . |
| 5,484,094 | 1/1996 | Gupta . |

OTHER PUBLICATIONS

"Gasoline Fuel Injector", Society of Automotive Engineers, Inc., Warrendale, PN, Nov. 1989.

"High Speed Fuel Injection System for Two–Stroke D.I. Gasoline Engine", Society of Automotive Engineers, Inc., Warrendale, PN, 1991.

"Daimler–Benz 2.3 Litre, 16–Valve High Performance Engine", Society of Automotive Engineers, Inc. Warrendale, PN, 1984.

"A New Series of Timing and Injection Rate Control Systems—AD–TICS and P–TICS", Society of Automotive Engineers, Inc., Warrendale, PN, 1988.

"The United Technology Alpha Series Fuel Injector—High Performance at a Reduced Cost", Society of Automotive Engineers, Inc., Warrendale, PN, 1985.

"Impact of Gasoline Characteristics on Fuel Economy", Society of Automotive Engineers, Inc., Warrendale, PN, 1978.

"A Feedback Controlled Carburetion System Using Air Bleeds", Society of Automotive Engineers, Inc. Warrendale, PN, 1977.

"Caterpillar's New Sleeve Metering Fuel Injection Systems", Society of Automotive Engineers, Inc., Warrendale, PN, 1977.

10
11
12
12a
12b
13
14
16
18
20
22
24
26
28
30
32
34
36
38
40
40a
40b
40c
42
44
46
48
50
56
58
60
62
64
66
68
70
72
74
76
78
80
82
84
85
86
90

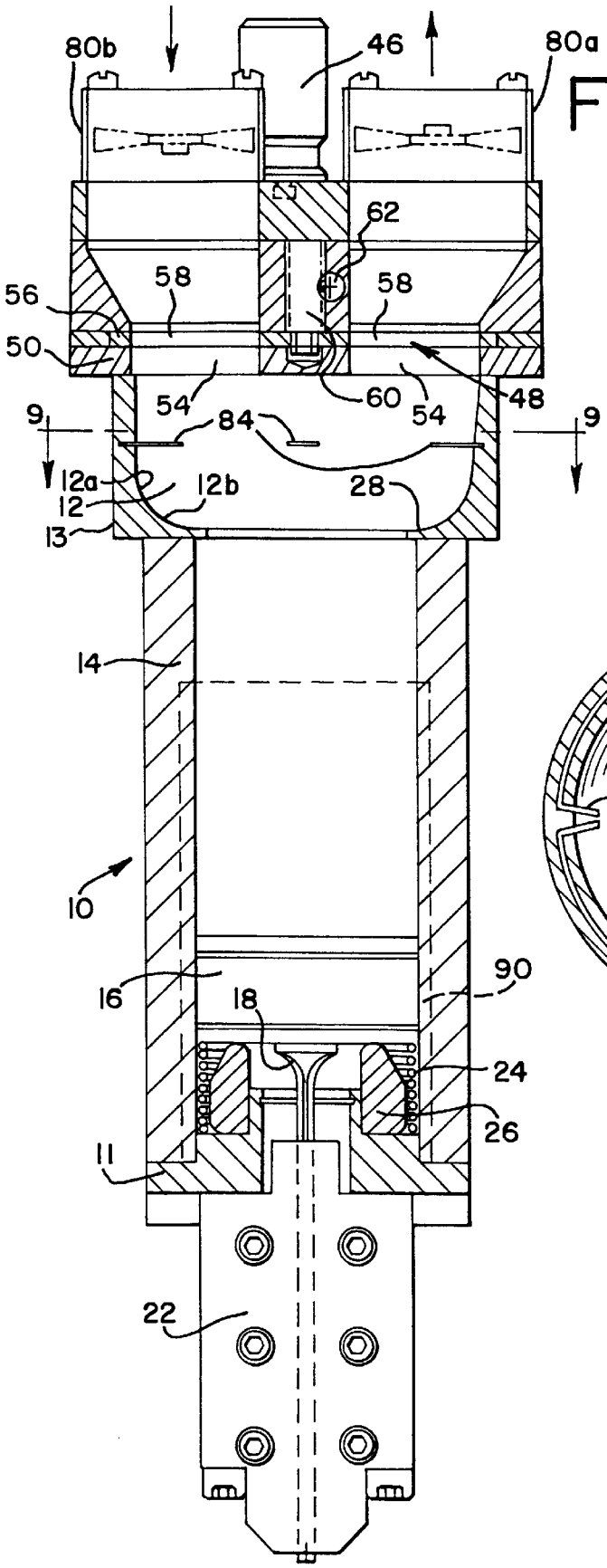
FIG. 2
FIG. 9
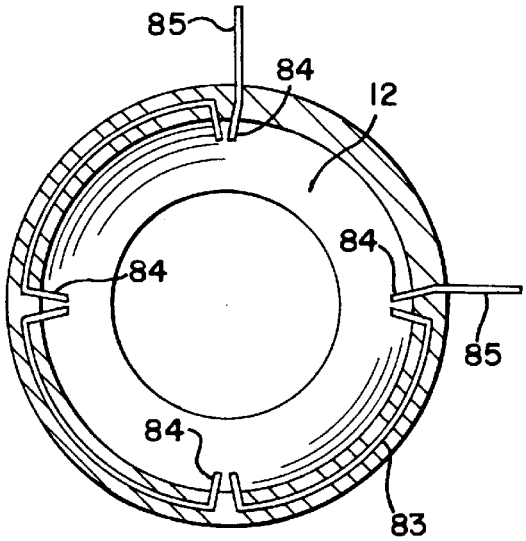

CAM UP

CAM DOWN

INTERNAL COMBUSTION POWERED TOOL

CROSS REFERENCE TO RELATED APPLICATIONS

This application is a division of application Ser. No. 08/447,787, filed May 23, 1995, now U.S. Pat. No. 5,752,643.

TECHNICAL FIELD

The present invention relates generally to cordless, self-contained tools and, more particularly, to internal combustion powered tools, such as hand-held fastener driving tools and the like.

BACKGROUND OF THE INVENTION

Internal combustion gas-powered hand tools, such as fastener driving tools, are well known in the art. U.S. Pat. No. 4,403,722 to Nikolich and U.S. Pat. No. 5,090,606 to Torii et al., disclose two such tools. Both of these patents disclose portable or self-contained fastener driving tools, i.e., the tools include their own source of fuel (typically propane).

One of the persistent issues in the development of gas-powered tools is reliable ignition of the fuel-air mixture and generation of sufficient power for driving nails or performing other high-power requirement tasks. The flammability limits of propane in air are about 2.2% to 9.5% by volume. When combusted, fuel-to-air ratios in the mid to low end of this range ("lean" mixtures) release the most energy, provide the greatest driving force, and use the fuel most efficiently.

Lean mixtures, however, are often difficult to ignite. Fuel-to-air ratios in the mid to high range ("rich" mixtures) release relatively less energy, produce less driving force, and use more fuel per cycle. Rich mixtures, however, are typically more easily ignited than lean mixtures. The hand tools disclosed in the Torii and Nikolich patents, for example, use a system of baffles or a fan within the combustion chamber to enhance mixing of the fuel-air mixture to provide more reliable and efficient ignition, particularly for lean mixtures.

Although the tools shown in Torii and Nikolich may function generally satisfactorily, the internal construction of the tools is very complicated, employing reciprocating cylinders or sleeves that require o-ring seals and resulting in a serpentine path for introduction of fresh air and/or the exhaust of combustion products. One of the significant drawbacks with the complicated construction is that it adds to the manufacturing and assembly cost, as well as to the weight of the device, which is important for portability.

In addition, the indirect and tortuous flowpath for exhaust and replacement air inhibits the evacuation or "scavenging" of the gaseous combustion products and unburned fuel from the interior of the tool. If uncombusted fuel remains in the combustion chamber it is difficult to accurately control the fuel-to-air mixture in the subsequent combustion cycle, which is required for maximizing the efficiency of the tool. Incomplete scavenging may result in the fuel-to-air ratio in subsequent cycles being higher than desired, leading to less power.

Accordingly, it is an object of the present invention to provide internal combustion gas-powered self-contained tool that has increased efficiency of operation. More particularly, it is an object of the present invention to provide such an internal combustion tool that utilizes an improved scavenging system. It is a further object to provide such a tool that accurately delivers an appropriate amount of fuel to the combustion chamber so that optimal the fuel-to-air ratio can be attained. It is another object of the present invention to provide an internal combustion tool that may be efficiently manufactured and assembled. It is a still further object to provide an improved sparking device or spark source for such a tool so as to provide more reliable combustion of lean fuel-to-air mixtures.

SUMMARY OF THE INVENTION

According to the present invention, there is provided an internal combustion tool, such as a tool for driving fasteners, which comprises a cylinder and a piston reciprocally moveable within the cylinder, and a combustion chamber defined at one end of the cylinder. The tool may include, in one embodiment, a rotary exhaust and/or intake valve in communication with the combustion chamber, which rotary valve includes first and second relatively rotatable plates in generally face-to-face relationship. The first and second plates each include at least one port or aperture, and one or both of the plates are rotatable to move the apertures into communication to allow gas flow into and/or from the combustion chamber or out of communication to substantially close and seal the combustion chamber.

In another embodiment, the tool may include a control system for controlling the flow of fuel through a fuel passageway between a fuel source and the combustion chamber. The control system includes a metering valve and a pressure regulator associated with the fuel passageway, and a control circuit operatively connected to the metering valve. The control system, if desired, may be responsive to ambient temperature and atmospheric pressure for delivering a selected quantity of fuel to the combustion chamber.

The tool may also include, in yet a further embodiment, a conductor defining a plurality of spark gaps at spaced locations within the combustion chamber for igniting the fuel-air mixture therewithin. A voltage source connected to the conductor applies an electrical voltage across the spark gaps to cause a plurality of sparks within the combustion chamber to enhance the reliability of combustion of the fuel-air mixture.

When used as a fastener driver, the tool may include a fastener driver associated with the piston, which driver engages fasteners that are fed into registration therewith from an associated magazine. Such a fastener driving tool also includes a fuel flow passageway that communicates with a fuel source and the combustion chamber. Interposed between the fuel source and the combustion chamber is a metering valve that controls the flow of fuel through the passageway and into the combustion chamber. A sparking device or spark source is associated with the combustion chamber for igniting the fuel introduced into the chamber. In this embodiment, the combustion chamber includes first and second ends, with a sidewall therebetween. The piston defines a portion of the first end and an inlet and/or exhaust valve defines a portion of the second end. The inlet and/or exhaust valve includes a pair of diametrically opposed ports or apertures that may be opened or closed. At least one fan is provided external of the combustion chamber and in communication with the apertures for inducing a flow of combustion products out one aperture and a flow of ambient air into the other aperture to scavenge combustion products from the combustion chamber and introduce fresh ambient air thereinto for the next combustion cycle.

This summary is intended as a brief introduction only, many other features and advantages of the present invention will become more apparent from reference to the following detailed description and accompanying sheets of drawings in which a preferred embodiment incorporating the present invention is shown by way of illustrative example.

BRIEF DESCRIPTION OF THE DRAWINGS

FIG. 2 is a front, elevational view in partial cross-section taken along line 2—2 in FIG. 3 of the fastener driving tool of FIG. 1 in the "driven" condition;

FIG. 9 is a cross-sectional view of the combustion chamber of the tool taken along line 9—9 of FIG. 2 and showing a sparking device or spark source providing multiple spark gaps;

DETAILED DESCRIPTION OF THE PREFERRED EMBODIMENT

Figures 1, 7, 8:
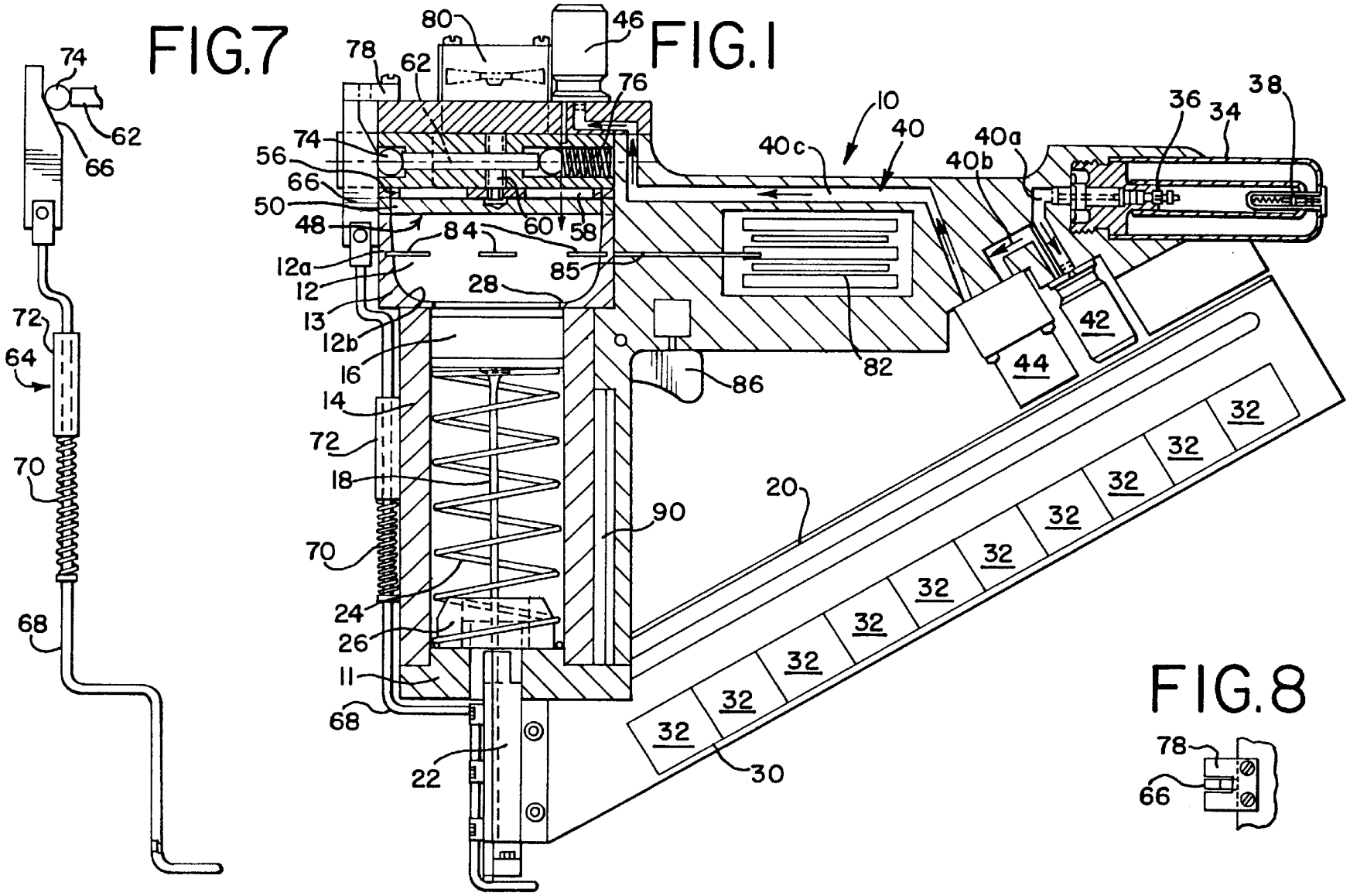
FIG. 1 is a side, elevational view in partial cross-section of an internal combustion gas-powered fastener driving tool according to a first embodiment of the present invention in the "standby" condition.
FIG. 7 is a view of the push rod and camming mechanism for actuating the rotary valve of the tool of FIG. 1.
FIG. 8 is a top view of the position detector associated with the push rod/camming mechanism shown in FIG. 7.
Figure 3:
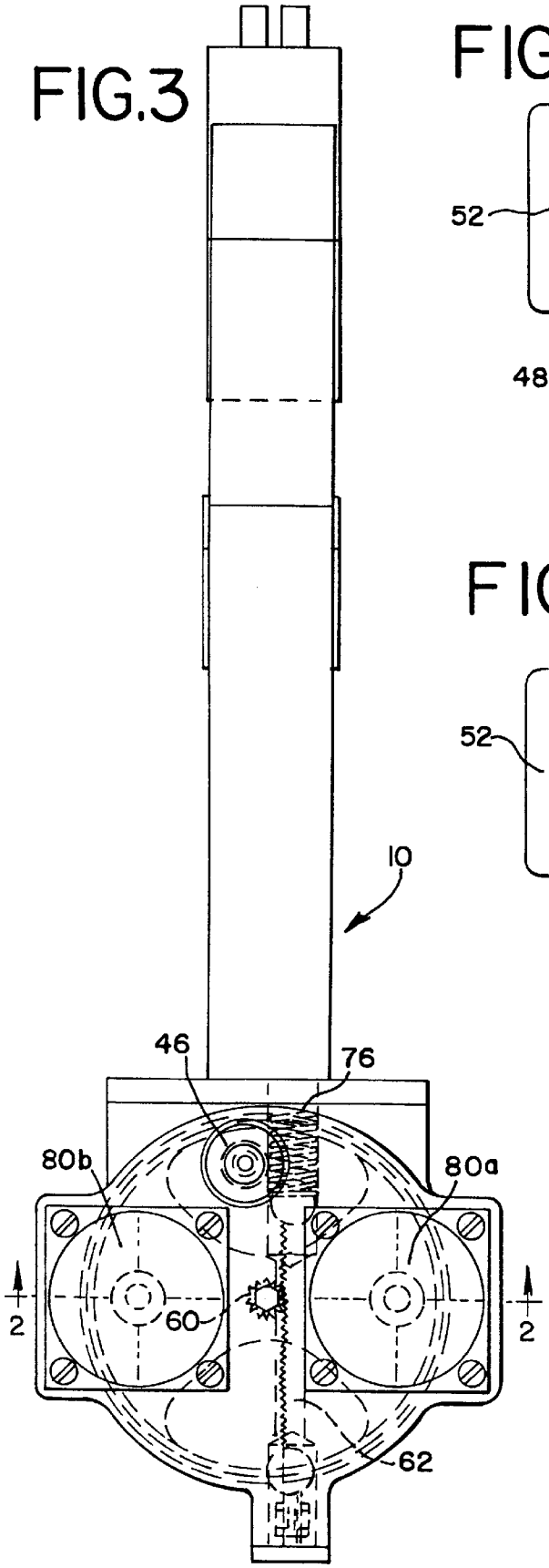
FIG. 3 is a top elevational view of the fastener driving tool of FIG. 1.

Referring to the drawings wherein like reference characters designate like parts throughout the several views, FIGS. 1, 2 and 3 show an internal combustion powered, self-contained tool in the form of a fastener driving tool, generally designated as 10, according to a first embodiment of the present invention. Although the present invention is described herein as embodied in a fastener driving tool, various aspects of the present invention may have application in other types of hand tools and gas-powered devices. To determine the scope of the present invention, reference should be made to the attached claims, and this description is intended for purposes of disclosure and illustration, and not for purposes of limitation.

The tool 10 includes a combustion chamber 12 which communicates with the bore of a cylinder 14, and a piston 16 which is reciprocally moveable within the bore. The cylinder 14 may be made of steel, aluminum, or any other suitable material of sufficient strength, hardness and heat resistance. The cylinder 14 is mounted between end cap 11 and head 13 (which contains the combustion chamber 12).

The head 13 also may be made of steel, aluminum or other material of sufficient strength and heat resistance. Preferably, for reasons described in more detail later, the head is made of a high strength dielectric material, such as plastic or ceramic, which permits a sparking device, such as a spark conductor to be molded directly into the wall of the combustion chamber. The combustion chamber 12 is preferably in the general shape of a bowl, with a bottom (formed by the top of the piston 16), side walls 12*a*, which may be cylindrical or slightly tapered, and a radiused transition 12*b* therebetween. The radiused transition 12*b* between the bottom and sidewalls 12*a* provides for better air flow in the combustion chamber 12 and promotes more complete scavenging of combustion products, as will be discussed in greater detail later.

The piston 16 is of standard construction, and also made of suitable high strength and heat resistant material. A pair of metal rings or resilient o-rings may be used to seal between the side of the piston and the surface of the cylinder bore. In the illustrated embodiment, the piston engages a driver blade 18 upon actuation of the tool so as to drive a fastener (not shown) which is fed into registration with the driver blade 18 by a magazine 20 at a guide plate 22 (best seen in FIG. 2). The fastener magazine and guide may be constructed in accordance with well known fastener driver magazines, such as that found in fastener drivers by Senco Products, Inc., model no. SFN40, for example, or shown in U.S. Pat. No. 4,721,240, incorporated by reference herein. The present invention is not directed to the magazine itself.

For uses other than fastener or staple driving, the piston 16 may be attached to or drive other devices, such as a gear drive to convert the linear motion of the piston into a rotary motion.

As shown in FIG. 1, the tool 10 is in the "standby" position, with the combustion chamber 12 sealed and the piston 16 and driver blade 18 in the top dead center position ready to engage a fastener and drive it into a workpiece (not shown). Associated with the piston 16 and driver blade 18 is a return spring 24, which returns the piston 16 and driver blade 18 to their standby positions after actuation of the tool 10. When fired, the piston 16 and driver blade 18 attain position shown in FIG. 2. As seen in FIG. 2, a tapered rubber bumper 26 limits the downward movement of the piston 16 and also serves as a centering guide for the return spring 24. The upward return movement of the piston is limited by a lip 28 on the combustion chamber that overhangs the upper edge of the cylinder 14.

The tool 10 may include a rechargeable nickel-cadmium battery pack 30 that powers the various control, metering, ignition, and scavenging subsystems of the tool. The battery pack 30 is operatively connected to the various subsystems and switches by a standard wiring harness (not shown). As shown, the battery pack 30 use ten 1.2 volt batteries 32 to provide for a 12-volt system. However, different batteries or different numbers of batteries may be used to provide for other low voltage sources. Although the voltage selected may vary, it is preferably 12 volts or less, depending upon particular components used in the tool's subsystems.

The fuel system for the tool 10 includes a fuel source, such as in the form of a detachable fuel canister 34. In the preferred embodiment, the fuel is liquified petroleum gas (propane) stored as a liquid at its vapor pressure. While propane ($C_3H_8$) has been used, other fuels having similar characteristics such as butane ($C_4H_{10}$) or commercially available MAPP gas could be used without departing from the present invention. An important characteristic for the fuel is that it is capable of being stored as a liquid and that it becomes a gas at atmospheric pressure and ordinary operating temperatures.

The fuel canister 34 is designed to meet Department of Transportation specifications for transportable LPG cylinders. The canister may be typically fabricated of steel and have about a 3-ounce capacity. The canister 34, as now contemplated, includes a standard tire-type valve 36 that opens as the canister 34 is screwed into its receptacle in the tool handle to admit fuel to the tool 10. The canister 34 also includes a combination relief and vent valve 38.

In the fuel canister 34, fuel is stored as a liquid at its vapor pressure. For propane at 70° F., this is 109.3 PSIG. Fuel from the canister 34 is introduced into the combustion chamber 12 of the tool 10 through a fuel flow passageway generally indicated by 40. The fuel expands into a gas as it leaves the canister 34 and travels along passageway portion 40*a* to a normally-closed latching solenoid valve 42. The latching solenoid valve 42 serves an important safety feature in that it precludes the flow of any fuel into the tool when the tool has not been fired for several minutes or when the power has been interrupted (such as by exhaustion of the batteries).

From the latching solenoid valve 42, the fuel travels through passageway portion 40*b* through a pressure regulator 44 which allows further expansion of the fuel to a desired metering pressure. The desired metering pressure may be set or selected on a one-time basis or may be variable, either manually or electronically, to adjust for operating conditions. For example, a metering pressure of 20 PSIG or less is preferred for propane fuel, with lower pressure being preferred for very low temperature operation.

Gaseous fuel travels along fuel flow passageway portion 40*c* to a metering solenoid valve 46 that delivers a precise amount of fuel to the combustion chamber 12 prior to ignition. In practice, the metering solenoid valve 46 may be a valve of the type manufactured by Angar Scientific, Inc. of Cedar Knolls, N.J., part no. AM2106 50 PSI 4494 6-V.

The open time for the metering valve is selected to provide the desired fuel-air ratio, which is preferably lean for high power uses such as driving nails and fasteners. The open time required may vary with the metering pressure, the valve orifice size, and the combustion chamber volume. For example, shorter time may be required to obtain the desired fuel-air ratio when a higher metering pressure and/or the larger valve orifice size and/or smaller combustion chamber volume is employed. In one test, conducted at normal room temperature, satisfactory combustion was achieved using propane fuel, the Angar Scientific metering valve 46 identified above, a metering fuel pressure of about 20 PSIG, and a combustion chamber having volume of between about 8 and 14 cubic inches, such as about 10 cubic inches, when the metering valve remained open for about 35 milliseconds. Because the valve 46 is held open for a fixed time interval, and the internal orifice of the valve 46 is fixed in size, a precise amount of fuel enters the combustion chamber each time it is actuated. A control circuit described later, for the valve may also be responsive to the ambient temperature and/or atmospheric pressure to control the valve-open timing and therefore, the amount of fuel under varying conditions.

In keeping with one aspect of the present invention, an improved scavenging system is provided for an internal combustion tool. The scavenging system employs at least one fan 80 external to the combustion chamber 12 for removing combustion products from and for introducing fresh ambient air into the combustion chamber. Because the fan is external to the combustion chamber the air in the chamber is relatively quiescent, rather than turbulent as in, for example, the prior art Nikolich patent which uses a fan actually in the combustion chamber. Interposed between the fan and the combustion chamber is an intake and/or exhaust valve 48 which is normally open to circulate fresh air through the combustion chamber. When the valve is closed, the combustion chamber is sealed.

The intake and/or exhaust valve preferably comprises a rotary valve having two plates or disks 50 and 56 in face-to-face relationship. The plates include ports or apertures 54 that, when the valve is open, are aligned to permit scavenging of the combustion chamber by the fan.

Figure 5:
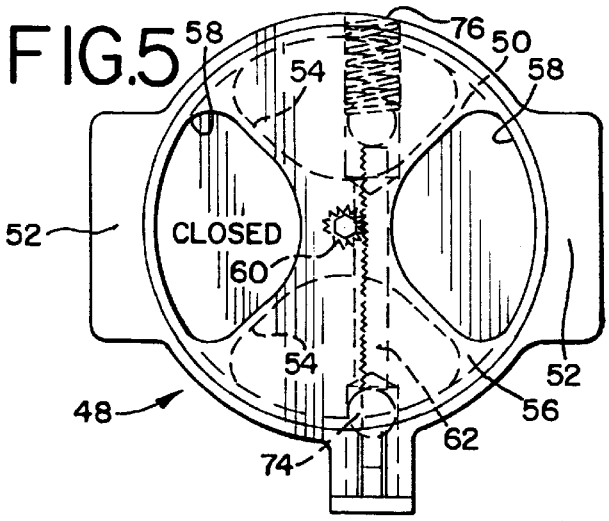
FIG. 5 is a top view of the rotary valve of FIG. 4 in which the valve is in its closed condition.
Figure 4:
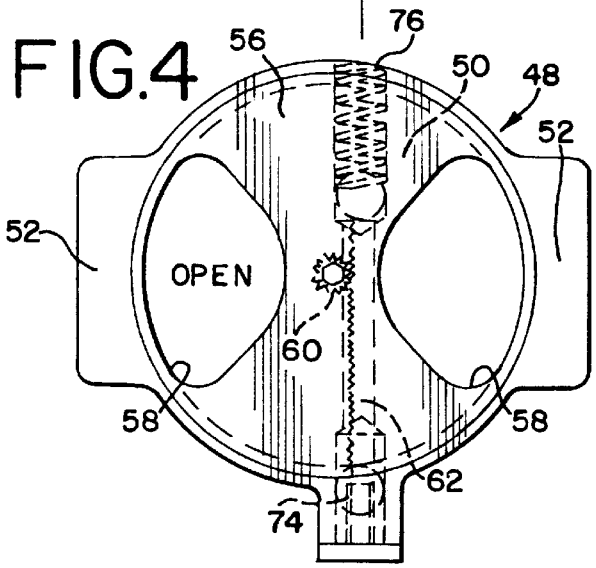
FIG. 4 is a top view of the rotary valve associated with the tool of FIG. 1 in which the valve is in its open condition.
Figure 6:
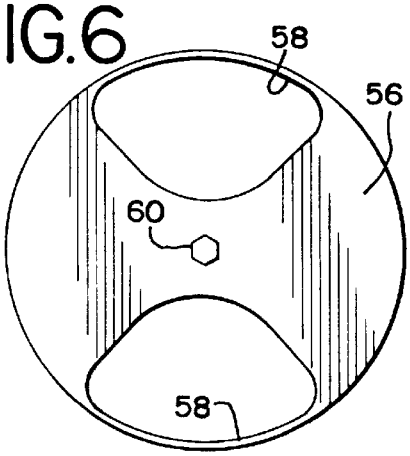
FIG. 6 is a plan view of one of the components of the rotary valve of the present invention.

Turning to FIGS. 4–6, there is seen a rotary exhaust valve, generally designated by 48, in accordance with the present invention. The rotary valve 48 includes a stationary plate or disk 50 having two ears 52 which permit the stationary plate 50 to be secured to the tool housing or head. The stationary plate 50 includes two substantially triangularly or pie-shaped apertures or ports 54 which are diametrically opposed. The apertures or ports are relatively large, each occupying approximately 20–25% of the surface of plate 50.

The rotary valve 48 includes a second plate or disk 56, best seen in FIG. 6, and shown in dotted lines in FIGS. 4 and 5. The plate 56 includes two apertures or ports 58 which are diametrically opposed and substantially the same size and shape as the ports 54 in the stationary plate 50. The plate 56 is mounted so that it is rotatable with respect to the stationary plate 50 between an "open" position, shown in FIG. 4, when the ports 58 in the plate 56 are aligned in a fully overlapping position with the ports 54 in the plate 50, and a "closed" position, shown in FIG. 5, when the ports 56 and 54 are completely out of alignment and there is no overlap between them. The configuration of the rotary valve results in exceptionally large inlet/exhaust ports with a very low pressure drop across the open ports. These large ports and low pressure drop facilitate highly efficient scavenging of exhaust gas through the open valve. This scavenging is further enhanced by the smooth bowl shape of the combustion chamber 12.

In order to rotate the plate 56 between the open and closed position shown in FIGS. 4 and 5, the plate 56 includes a pinion gear 60 that is engaged by a gear rack 62. In one embodiment, the gear rack is actuated by a camming mechanism best seen in FIG. 1 and generally designated by 64. The camming mechanism comprises a camming surface 66 and a pushrod 68 including a return spring 70. The camming mechanism 64 is secured to the exterior of the tool housing by means of a guide 72, through which the pushrod 68 slides and which is engaged by the return spring. The pushrod 68 acts as a safety probe and is configured so that the pushrod 68 acts to provide a sensing of when the tool is pressed against the surface of the workpiece into which the fastener is to be driven. When the tool is pressed against the surface, the pushrod 68 is moved to the position shown in FIG. 1—the "standby" position—in which the rotary valve 48 is closed (FIG. 5). To attain this position, as the push rod moves upwardly when pressed against a work piece (e.g., wood), the camming surface 66 engages the gear rack 62 by acting on a rotatable steel ball 74. The gear rack 62 then is moved against the force of a return spring 76 to rot at e the pinion gear 60, and consequently the plate 56, so that the rotary valve 48 is closed. When the tool is moved away from the surface of the workpiece, the return spring 70 moves the pushrod 68 to the position shown in FIG. 7, retracting the camming surface 66 and allowing the return spring 76 to move the gear rack 62, rotate the pinion gear 60, and rotate the second plate 56 so that its ports 58 are aligned with the ports 54 in the stationary plate 50 in the open position (FIG. 4). In this manner, the rotary valve is closed—closing the combustion chamber so that the tool can be fired—only when the tool is pressed against the workpiece into which the fastener is to be driven. As a further safety measure, the tool 10 may include an infrared emitter-detector 78 (FIGS. 1 and 8), positioned on the tool housing so that when the camming mechanism 64 has been actuated to close the rotary valve, the cam 66 breaks the beam of the infrared emitter-detector 78, sending a signal that permits the tool 10 to be fired. A mechanical switch also could be substituted for the infrared detector.

As an alternative to the mechanical cam 66, a commercially available rotary solenoid 79 (best seen in FIGS. 10–14) can be employed to move the rotary valve 48 between its open and closed positions. The rotary solenoid 79 includes a gear 79*a* whose teeth mesh with those on the rack gear 62. In this embodiment, the end of the pushrod 68 breaks the beam of the infrared emitter-detector 78 (rather than the camming surface 66 of the first embodiment) when the tool 10 is pressed against a workpiece to send a signal. That signal causes, through a control circuit, the solenoid to rotate and move this rack gear exhaust valve to a closed, sealed position. Release of the tool from the work piece allows the push rod to retract, opening the beam and causing a signal that results in turning of the solenoid to open the exhaust valve. Alternatively, instead of using a push rod, an infrared or other detector could be positioned at the nose of the tool to directly detect when the tool is pressed against a workpiece.

For reduced rotational friction between plates 50 and 56 of the rotary intake/exhaust valve, at least the facing surfaces of plates 56 and 50 have a reduced friction coating applied. This reduced friction coating may, for example, be a combination of anodizing and impregnating of low friction material such as polytetrafluoroethylene, more commonly known as Teflon® material. Such a process is commercially known as Dura-Kote NF, and is available from Universal Metal Furnishing, Co. of Carol Stream, Ill.

When the rotary valve 48 is in its open position (FIG. 4), combusted fuel can be scavenged from the combustion chamber 12. To this end, the tool 10 preferably incorporates two fans 80*a* and 80*b*, one associated with each aperture 54 of the stationary plate 50 of the valve 48. Fan 80*a* is oriented so that it blows fresh ambient air into the combustion chamber, while the other fan 80*b* pulls gas out of the combustion chamber. In practice, the fans 80*a*, 80*b* may be Panasonic FBK-04F12U (for a 12-volt system) or FBK-0405H (for a 6-volt system) fans, or other suitable fans from other suppliers. While two fans may provide faster scavenging for fast repeat cycling, a single fan will also work because of the large size of the openings in the rotary valve. Use of a single fan may result in the need for more time between successive firings of the tool. However, the use of a single fan will extend the battery life. Because of the large diametrically opposed apertures or openings in the rotary valve and radiused transition portion 12*b*, even a single fan will provide a large and efficient flow of air through the combustion chamber, following a generally U-shaped path that passes across the top surface of piston 16, to remove combustion products and introduce fresh ambient air.

Although not as efficient, a single fan in combination with single large port or aperture in the rotary exhaust/intake valve may also provide sufficient scavenging and fresh air introduction for certain applications. This could be, for example, (1) a single fan which causes both intake and exhaust through a single port or aperture in the rotary valve such as by blowing intake air through the center of a port or aperture, with exhaust gas flowing in an opposite direction through an annular portion of the port or aperture or (2) a single fan associated with a single port or aperture in the rotary valve for creating a flow of air between that port or aperture and another port or aperture located elsewhere in the tool. In addition, filter screens may be provided over each fan, particularly any fan blowing into the combustion chamber, to filter out ambient dust or contaminants.

In keeping with a further aspect of the invention, the tool 10 is provided with an ignition system that promotes reliable and complete combustion, particularly when used in conjunction with lean fuel-to-air mixtures. The ignition system includes a voltage source, such as an ignition coil, for generating the electrical pulse and a spark ring of conductive material disposed within the combustion chamber and having a plurality of spark gaps.

Turning to FIG. 1, there is seen a voltage source in the form of an ignition coil 82 which generates the electrical pulse needed for the ignition system. The combustion chamber 12 includes a spark ring 83 (FIG. 9) having a plurality of spark gaps, such as the illustrated series of four spark gaps 84 disposed within the combustion chamber 12. The spark gaps 84 are formed by spaced conductors connected in series to the ignition coil 82 by a conducting element 85, with the ignition coil 82 being actuated by a trigger switch 86. As best seen in FIG. 9, the spark gaps 84 are arranged in a co-planar fashion equidistantly about the cylindrical periphery of the combustion chamber 12. The resulting wide separation of the spark gaps within the combustion chamber enhances the likelihood of ignition of the fuel. In practice, the spark gaps 84 may be formed of copper or other conductive material such as steel wire molded into the high dielectric plastic or ceramic material used to form the combustion chamber 12, with the gaps being in the range of about 0.025 to 0.050 inches.

Close proximity of the spark gaps 84 to the chamber wall understood to inhibit ignition even when all other conditions are favorable. Consequently, each spark gap 84 preferably is spaced from the interior surface of the combustion chamber 12 to better insure consistent ignition. Applicants have determined that a spacing of about ⅜ inch or more from the interior surface of the combustion chamber wall 12*a* provides for generally reliable ignition of propane, by even a single spark source. The minimum and optimum spacing have not been precisely determined at this time, and may vary depending on the spark source, type of fuel and operating conditions. A multiple spark source such as shown in FIG. 9 may, for example, provide reliable ignitions closer to the wall surface, such as from about ⅛ to ⅜ inches or more.

Because the spark gaps 84 are arranged in a series, each pulse of the ignition coil 82 causes four substantially simultaneous sparks to occur, resulting in four opportunities for ignition to occur. The ignition coil could also be pulsed several times in quick succession to create even further opportunities for ignition during each combustion cycle. While the preferred embodiment has been shown with four spark gaps, more could be utilized providing for even greater possibilities of ignition, or fewer could be utilized to reduce the voltage required to produce sparking while still enhancing ignition as compared to a single spark source.

Figure 10:
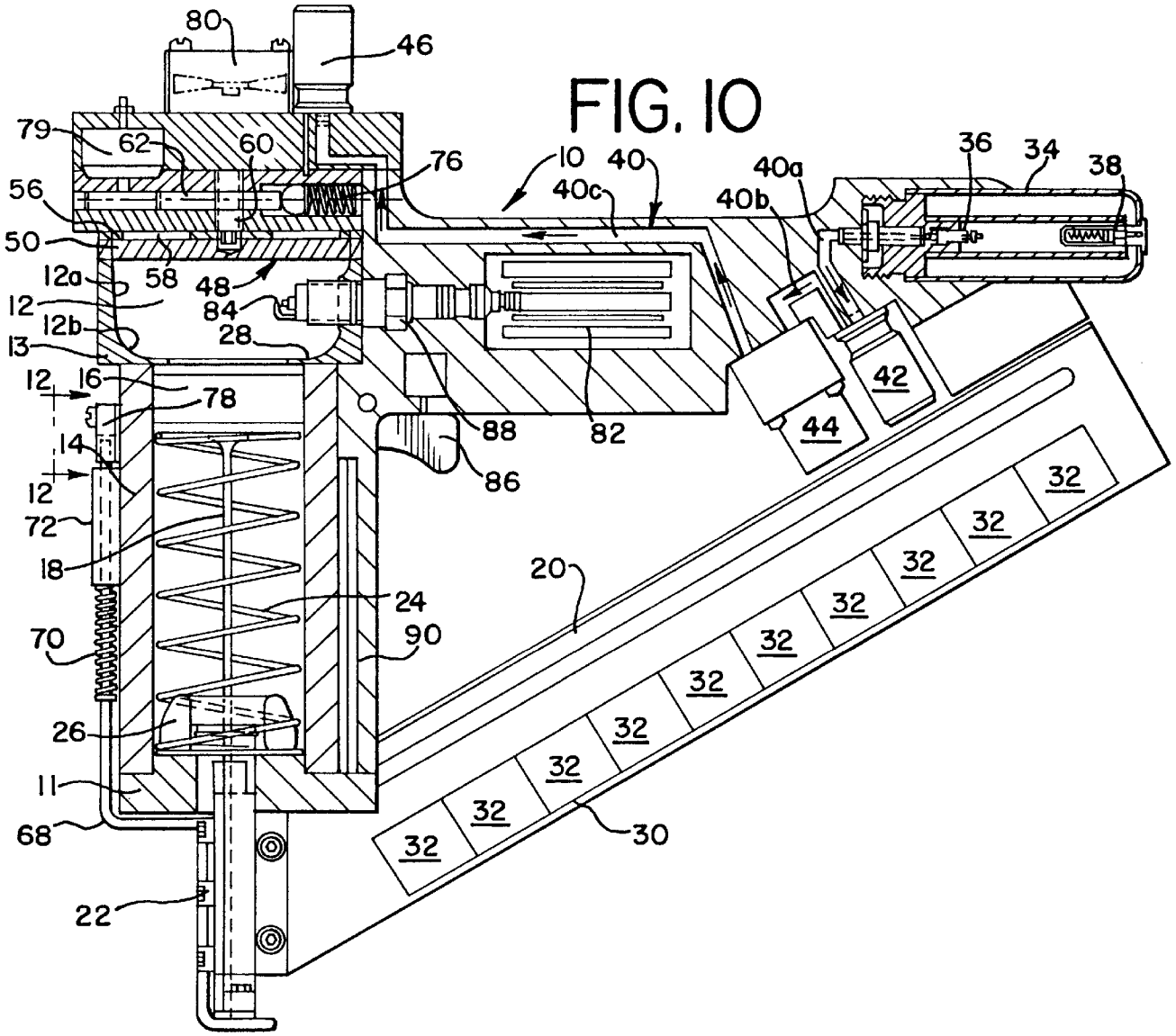
FIG. 10 is a side, elevational view in partial cross-section of a fastener driving tool that is an alternate embodiment of the present invention.
Figure 11:
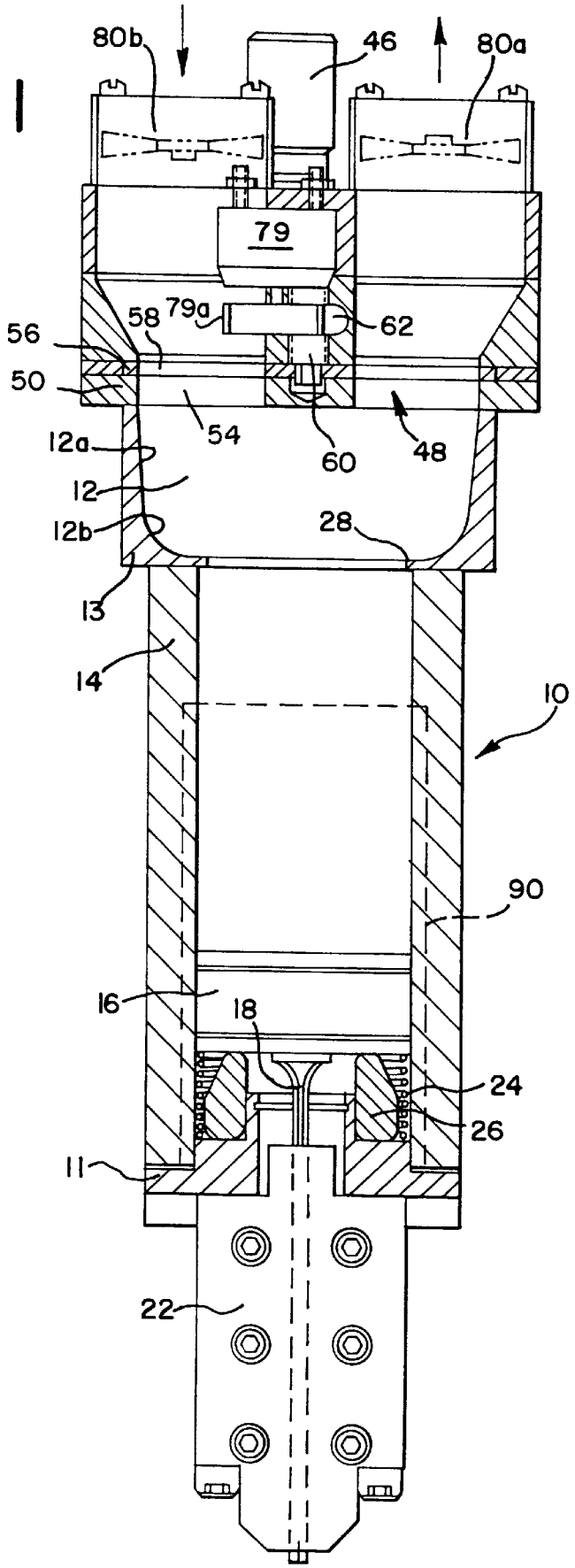
FIG. 11 is a front elevational view in partial cross-section of the fastener driving tool of FIG. 10.
Figure 12:
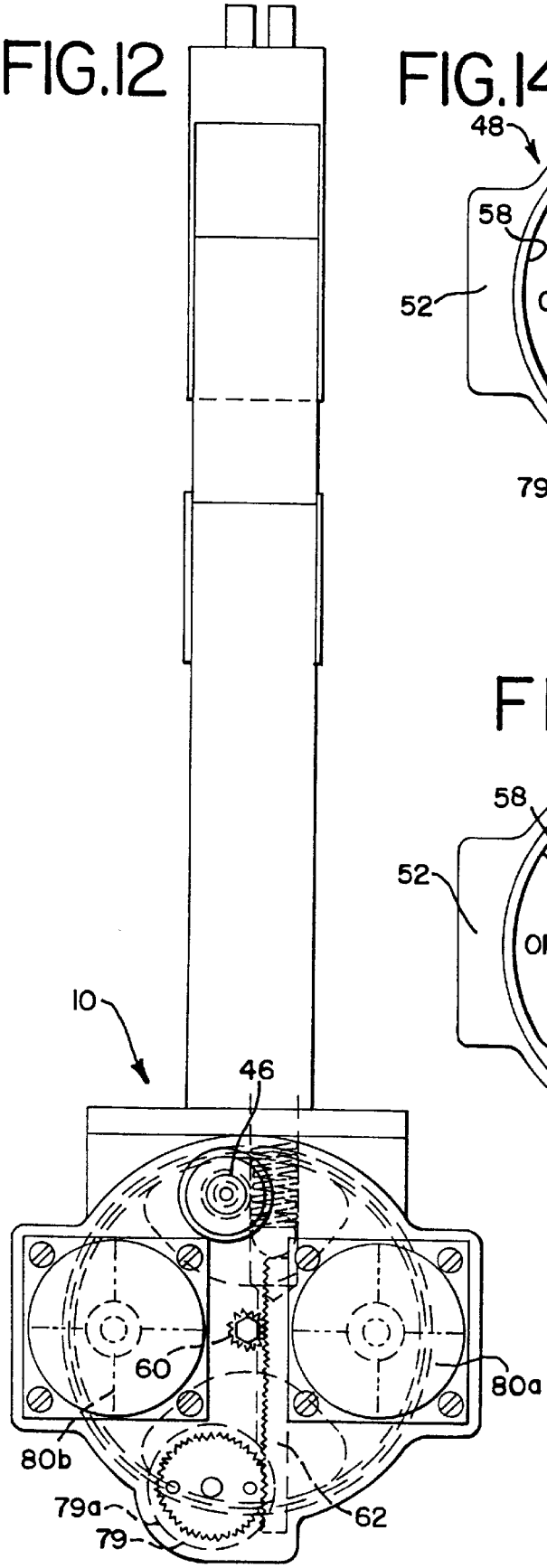
FIG. 12 is a top elevational view of the fastener driving tool of FIG. 10.
Figure 14:
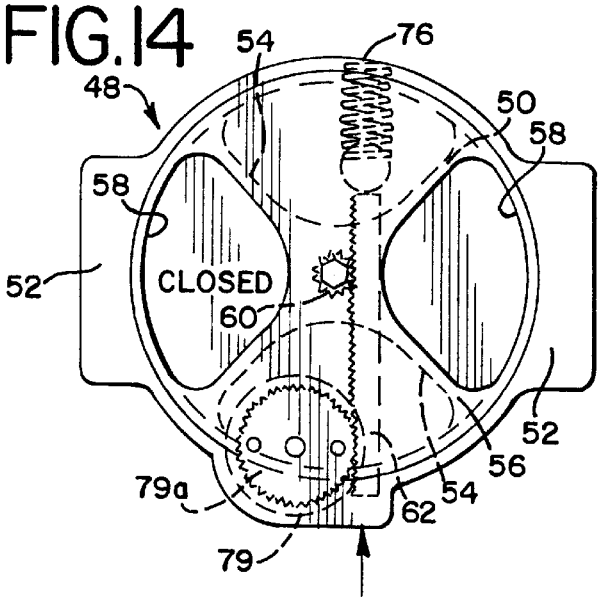
FIG. 14 is a top view of the rotary valve of FIG. 13 in which the valve is in its closed position.
Figure 13:
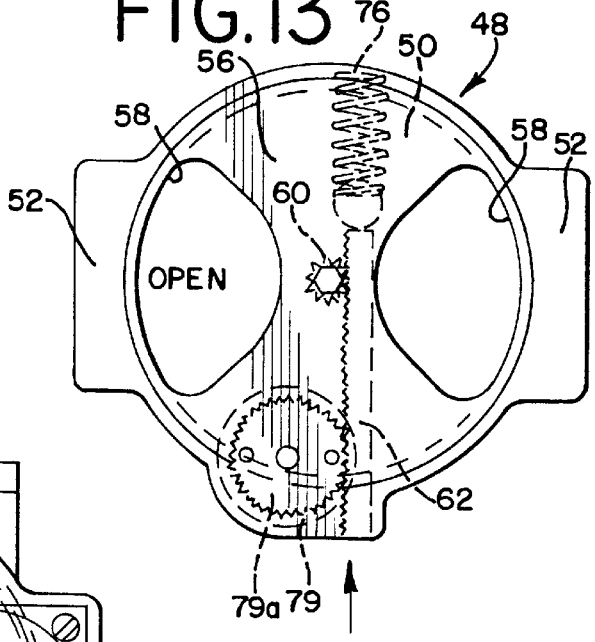
FIG. 13 is a top view of the rotary valve associated with the fastener driving tool of FIG. 10 wherein the valve is in its open position.

In an alternate embodiment, shown in FIG. 10, a conventional spark plug 88, such as an automotive spark plug, can be used in place of the spark ring 83. As illustrated, the tip of the spark plug 88 is connected directly to the ignition coil 82 and is positioned so that the gap of the spark plug 88 is spaced from the wall of the combustion chamber 12 as described above. If a conventional spark plug is used, multiple voltage pulses from the ignition coil 82 for each combustion cycle may be used to provide for multiple opportunities for ignition.

The following summarizes the operation of the tool 10 thus far described. Assuming the combustion chamber 12 has been scavenged of spent gases from the previous cycle and the magazine 20 has positioned a fastener under the driver blade 18, the operator presses the pushrod/safety probe 68 against the workpiece to cause the camming surface 66 to actuate the gear rack 62 and pinion gear 60 to close the rotary valve 48, thus trapping a volume of fresh air within the combustion chamber 12. When the beam of the infrared emitter-detector 78 is broken, the solenoid metering valve 46 is briefly opened to admit a predetermined quantity of fuel vapor into the combustion chamber 12. When the operator is ready to drive the fastener, the ignition coil 82 is actuated by squeezing the trigger switch 86 to initiate a series of rapidly sequenced high voltage sparks across the spark gaps 84 in the spark ring 83. The fuel ignites, forcing the piston 16 downward and driving the fastener. The force of expanding gases and inertia carries the piston 16 to the bottom of its stroke, where it collides with the rubber bumper 26. Then the return spring 24 moves the piston back to the top of its stroke, allowing the spring-loaded magazine 20 to position a new fastener under the driver blade 18. When the operator lifts the tool 10 away from the workpiece, the rotary valve 48 opens and the fans 80*a* and 80*b* start, allowing fresh ambient air to rapidly enter the chamber and the spent gases to be removed therefrom. If a new cycle is not initiated immediately, the fans 80*a*, 80*b* run for a few seconds and then stop. The rotary valve 48 remains open until the next cycle is initiated.

To provide correct sequencing and timing of the afore-described operation of the tool, e.g., the length of time the metering valve is left open, the generation of the spark for ignition, and the scavenging of combustion byproducts from the combustion chamber, a control circuit is provided that controls the operation of the tool, specifically the admission of fuel to the combustion chamber, generation of the ignition spark, rotation of the exhaust valve (in the solenoid-controlled version), and operation of the fans.

In one embodiment, the control circuit is comprised of a digital logic integrated circuit with spark, fuel and fan control phases, shown generally as part of the tool at 90. This circuit may be a separate hard-wired circuit, either conventional or integrated, or part of a programmable microprocessor that achieves the same function. Turning more specifically to FIGS. 19–22, there is shown a digital logic integrated circuit with ignition, fueling and fan control phases, which comprise the control system 90.

In the operation of the control circuit, a circuit cycle includes the process of injecting fuel into the combustion chamber 12 (fueling phase) and generating an electrical spark for ignition of the air-fuel mixture inside the combustion chamber 12 (ignition phase). Each cycle is initiated with the activation of a triggering device (not the trigger 86). The triggering device can be, for example, a mechanical switch, e.g., a single-pole double-throw (SPDT) limit switch, followed by a switch debouncing stage, or an opto-electronic switch, which may comprise an infrared emitter-detector pair 78 activated by an interrupter 66 and/or a reflective photo-switch, followed by an electronic signal conditioning stage. Regardless of the type of triggering device employed, the actual triggering is preferably initiated by, for example, a mechanical attachment to the actuating linkage for the rotary valve 48 or electronic input from the circuit controlling movement of rotary solenoid 79, so that a circuit cycle can only occur when the rotary valve 48 is fully closed.

Figure 15:
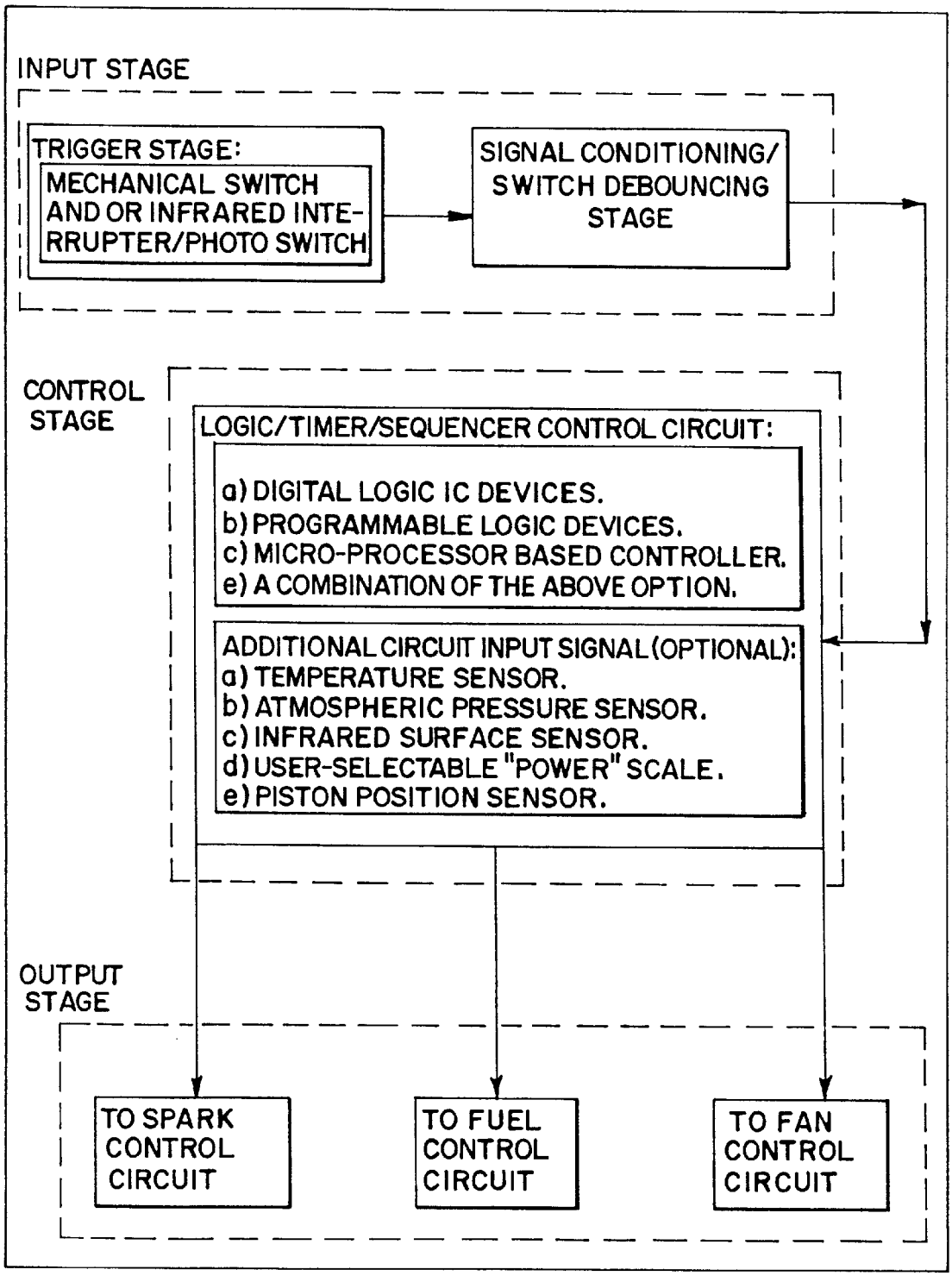
FIG. 15 is a block diagram of various stages of a control circuit for the tool of FIGS. 1 and 10.

The actual control stage of the circuit can be comprised of a digital logic integrated circuit (IC) design, programmable logic devices, a microprocessor based controller, or a combination of the previous options. As shown in FIG. 15, the same Input and Output Stages can be utilized with any design. The Input Stage may also contain fuel pressure as well as atmospheric temperature and pressure sensors to optimize the air-to-fuel ratio of the tool's combustion chamber at various ambient conditions. Additionally, the Input Stage may include a piston position sensor, a user selectable "power" scale and/or an infrared surface sensor. The infrared surface sensor being responsive to the temperature of the workpiece to prevent firing of the tool into a human body.

In one embodiment of the invention, the control circuit is comprised of a digital logic IC circuit. As shown in FIG. 19, the digital logic IC circuit is comprised of sequential fueling and ignition phases, as well as a parallel fan control phase. From FIG. 19, it can be seen that the first circuit branching occurs at junction A. Here, the logic-high signal, produced when the triggering device (mechanical or opto-electrical) is activated, is used in parallel by the fan control circuit (FIGS. 18 and 22) to turn on the fan motors and initiate their automatic time-out feature, and by the fuel control and spark control circuits (FIGS. 17 and 21, and 16 and 20) to initiate the fueling and ignition phase sequences, respectively.

The operation of the fueling and ignition phase sequences of the digital logic IC circuit will now be described with reference to FIG. 19. The logic-high signal at junction A passes through hex inverter buffers 100–107, which are used to generate time delays. These time delays depend on the "propagation delays" of the actual IC components used and are typically in the order of 25–35 nano-seconds per component. Hex inverter 100 turns off the "reset" signal to decade counters 110 and 112. Hex inverter 102 turns off the "set" signal to D flip-flops 114 and 116. Since the D and CLK inputs of flip-flops 114 and 116 remain at logic-zero, the respective outputs, Q1 and Q2, remain at a logic-high state. Q1 is applied as an input to AND gates 120 and 122, and Q2 is applied as an input to AND gate 126.

Hex inverters 103–07 create a time delay to allow decade counters 110 and 112 and flip-flops 114 and 116 to be properly initiated before activating the fueling stage. After this time delay, a logic-high signal is applied from hex inverter 107 simultaneously to AND gates 120 and 122. AND gate 120 is connected to the enable input of decade counter 110, which begins counting cycles from clock 132. The logic-high signal from AND gate 122 is fed to the fuel control circuit to begin injecting fuel into the tool's combustion chamber, the operation of which will be described later.

When decade counter 110 reaches the decimal number selected by count selector switch 136, a logic-high signal is fed to the "reset" input of D flip-flop 114, which changes the state of Q1 to logic-zero. When this occurs, AND gate 122 generates a logic-zero which is fed to the fuel control circuit to terminate the fueling phase. Decade counter 110 is also disabled at this time through AND gate 120. Thus, the amount of fuel to be injected can be varied by choosing a different decimal number at count selector switch 136.

In an alternate embodiment the amount of fuel to be injected is controlled by the fuel and atmospheric temperature and pressure sensors to optimize the air-to-fuel ratio to various ambient conditions. If the control stage of the circuit consists of a software-controlled microprocessor design, the signals from the various sensors are input to the microprocessor, which in turn selects a decimal number at the count selector switch 136 corresponding to the optimum air-to-fuel ratio for the given ambient conditions. If, however, a digital logic IC design is used for the control stage, the signals from the various sensors can be input to the count selector switch 136 through a sensor circuit (not shown). The sensor circuit being responsive to the signals from the various sensors and selecting a decimal number at the count selector switch 136 corresponding to the optimum air-to-fuel ratio for the given ambient conditions.

When the fueling phase is completed (logic-zero at AND gate 122), hex inverter buffers 140–48 create a time delay before starting the ignition phase. As previously noted, this time delay depends on the "propagation delays" of the actual IC components used and are typically in the order of 25–35 nano-seconds per component. Hex inverter 148 outputs a logic-high which is fed as an input along with the output of hex inverter 107 to AND gate 124. The logic-high signal generated by AND gate 124 is applied to AND gate 126, with the other input being signal Q2 from D flip-flop 116 (which is also at a logic-high). AND gate 126 enables decade counter 112 to start counting cycles from clock 134, and is also fed as an input to AND gate 128. The output of decade counter 112, specifically decimal numbers 1, 3, 5 and 7, are fed into or gate 130, the output of which is the other input of AND gate 128. This configuration generates a square waveform at the output of AND gate 128 consisting of four periods at half the frequency of clock 134. This square waveform is used by the spark control circuit to generate multiple sparks at the sparking device. At the fifth period, the logic-high generated at decimal number 9 of decade counter 112 is applied to the "reset" input of D flip-flop 116, which changes the output Q2 to a logic-zero. This disables decade counter 112 to prohibit further spark generation, thus completing the ignition phase.

It should be noted that if the triggering device is manually released during the execution of either the fueling or ignition phases, that phase is immediately terminated and the entire cycle is aborted. The only exception is the fan control circuit, which continues running until its internal time-out feature automatically turns off the motor.

Further, the above-described digital logic IC circuit can be replaced with a software-controlled microprocessor circuit, which can utilize the same Input and Output Stages of the digital logic circuit. The microprocessor circuit offers increased flexibility by virtue of being controlled by software. For example, in addition to executing the fueling, ignition and fan control phases, the software can also be used to implement ambient temperature and atmospheric and fuel pressure sensors to automatically fine-tune the air-to-fuel ratio to the given ambient conditions, thus improving combustion.

Although not depicted in the drawings, the control circuit may include means for controlling latching solenoid valve 42. As previously described, latching solenoid valve 42 is a normally closed valve and serves an important safety feature of preventing fuel from leaking into the tool when the tool has not been fired for several minutes or when the power has been interrupted (such as by exhaustion of the batteries).

If the control circuit is comprised of a digital logic IC circuit, a means for controlling latching solenoid valve 42 may include, but is not limited to, circuit means for generating and/or applying a voltage to open the normally closed valve and allow fuel to flow into the tool. The circuit means would be responsive to the closure of the rotary intake and/or exhaust valve or to the activation of the triggering device (mechanical or opto-electrical), to open latching solenoid valve 42 a predetermined amount of time before the fuel control circuit opens solenoid metering valve 46. As a safety feature, the circuit means would also include an automatic time-out feature designed to de-energize and close latching solenoid valve 42 after a specified period of nonuse of the tool or when the power has been interrupted.

If the control circuit is comprised of a software-controlled microprocessor circuit, the software can be implemented to control latching solenoid valve 42 in accordance with the characteristics described above.

Figure 16:
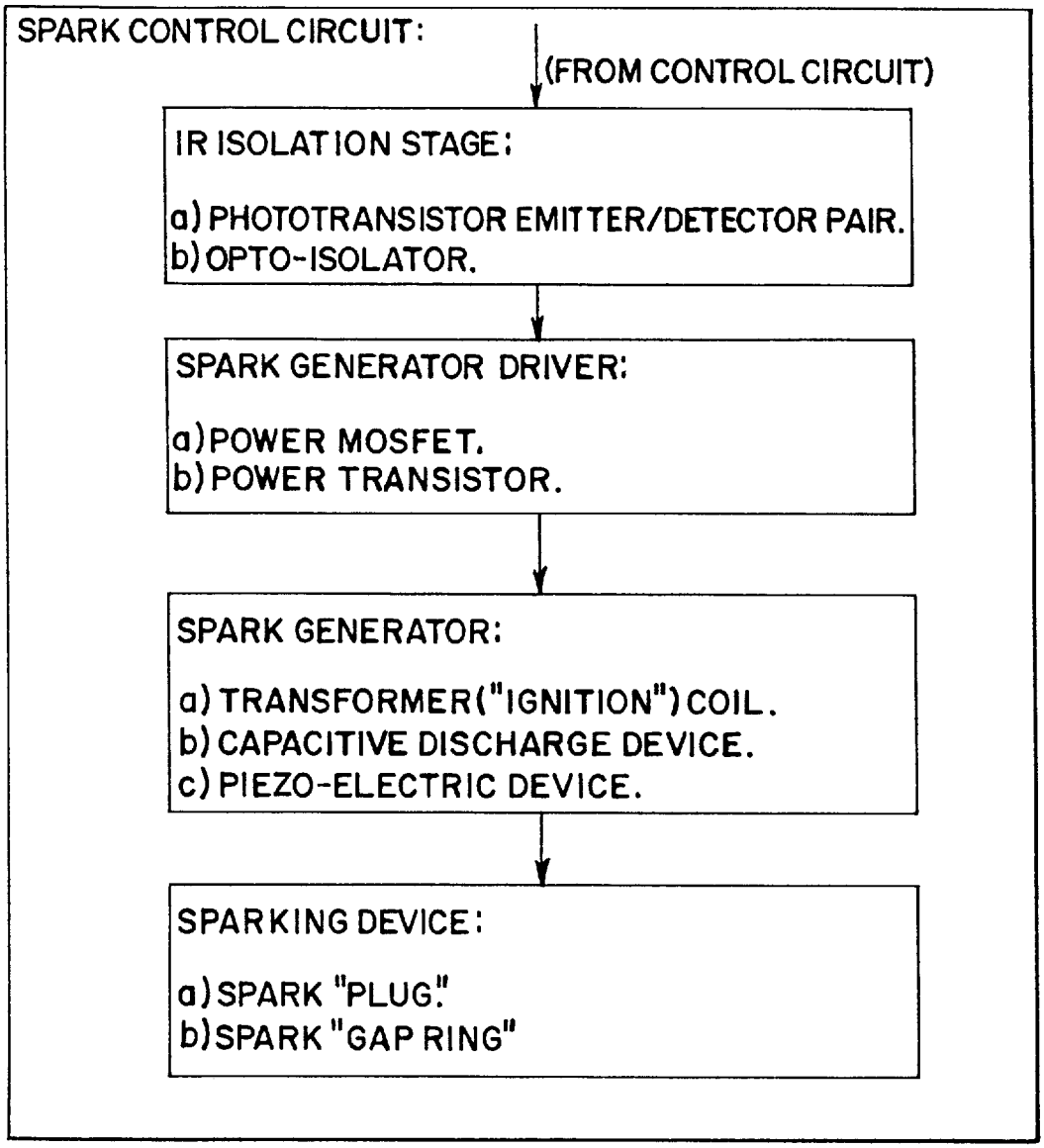
FIG. 16 is a block diagram of a spark control portion of the control circuit.

As can be seen from the block diagram in FIG. 16, the spark control circuit may comprise an IR isolation stage, a spark generator driver, a spark generator and a sparking device. Those skilled in the art will recognize the variations set forth in FIG. 16, which could be implemented to the spark control circuit.

Figure 20:
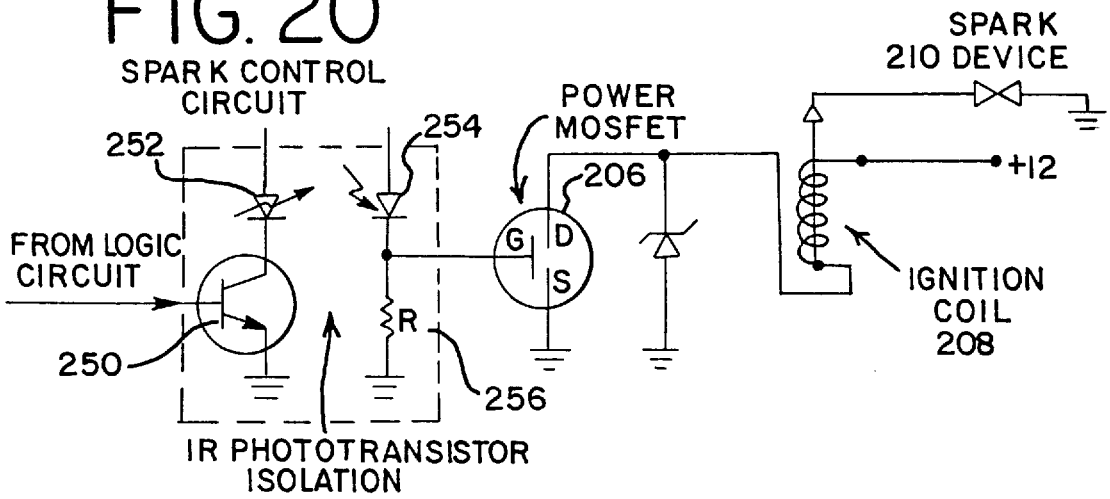
FIG. 20 is a circuit diagram of a spark control circuit for the control circuit of the present invention.

FIG. 20 depicts a circuit diagram of one variation of the spark control circuit. The basic operation of this variation of the spark control circuit is as follows. The output from the digital logic IC circuit is input to the gate of transistor 250. Thus, a logic-high from the digital logic IC circuit turns on transistor 250, which in turn allows a voltage source (not shown) to generate a voltage across emitter diode 252. The infrared light emitted from emitter diode 252 generates a voltage across detector diode 254. The cathode terminal of detector diode 254 is connected to the gate of power MOSFET 206 and also to a limiting resistor 256. The voltage generated across detector diode 254 turns on power MOSFET 206. When power MOSFET 206 is turned on, ignition coil 208 becomes charged and generates a spark at spark device 210.

Figure 17:
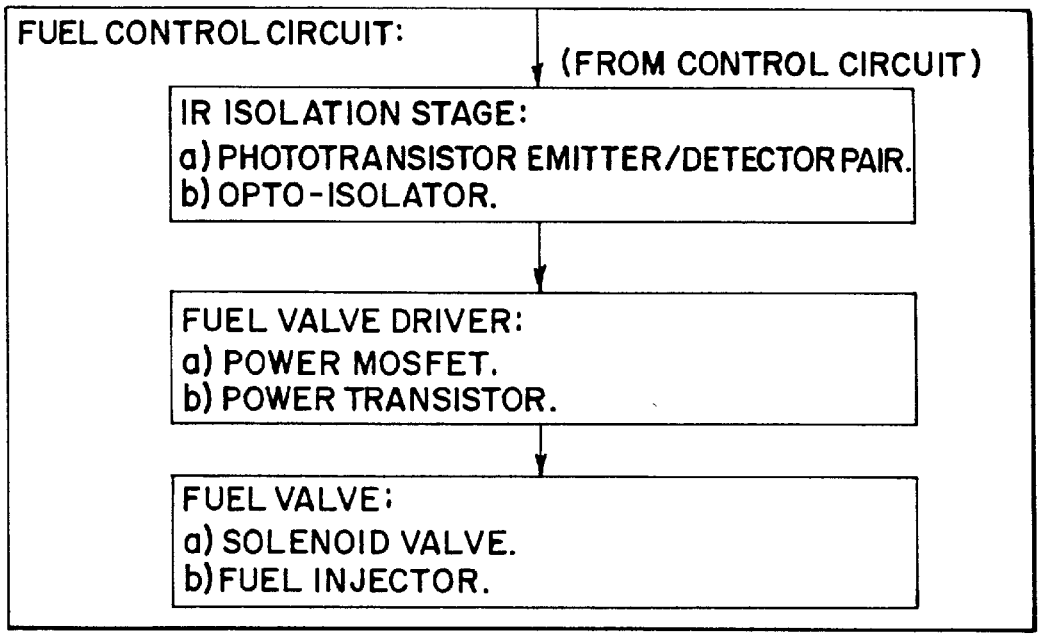
FIG. 17 is a block diagram of a fuel portion of the control circuit.

Referring now to the block diagram in FIG. 17, the fuel control circuit is essentially comprised of an IR isolation stage, a fuel valve driver and a fuel valve. Those skilled in the art will recognize the variations set forth in FIG. 17, which could be implemented to the fuel control circuit.

Figure 21:
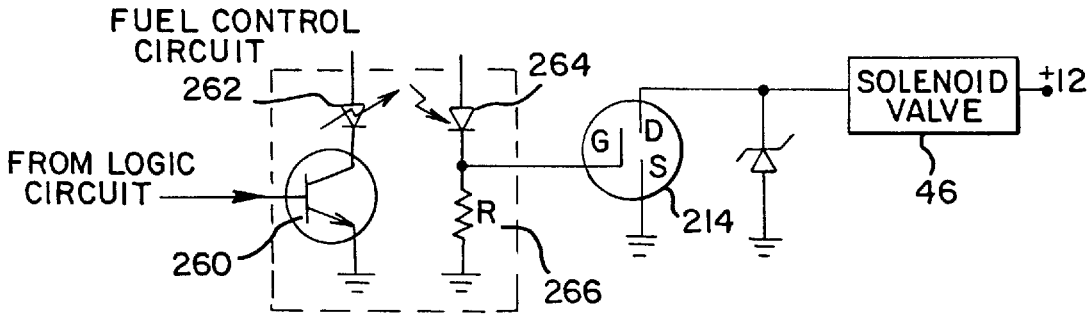
FIG. 21 is a circuit diagram of a fuel control circuit for the control circuit of the present invention.

FIG. 21 depicts a circuit diagram of one variation of the fuel control circuit. The basic operation of this variation of the fuel control circuit is similar to the spark control circuit described above. A logic-high from the digital logic IC circuit turns on transistor 260, which in turn allows a voltage source (not shown) to generate a voltage across emitter diode 262. The infrared light emitted from emitter diode 262 generates a voltage across detector diode 264. The cathode terminal of detector diode 264 is connected to the gate of power MOSFET 214 and also to a limiting resistor 266. The voltage generated across detector diode 264 turns on power MOSFET 214. When power MOSFET 214 is turned on, solenoid valve 46 opens and allows fuel to flow into the combustion chamber.

Figure 18:
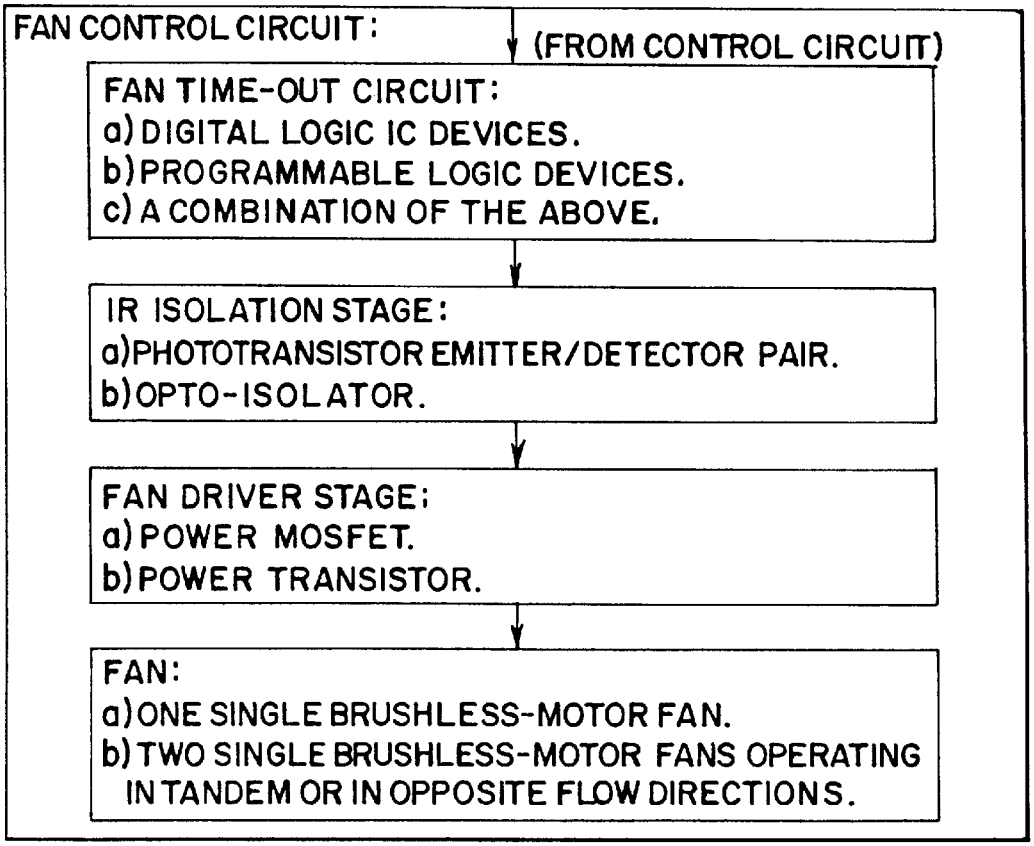
FIG. 18 is a block diagram of a fan control portion of the control circuit.
Figure 19:
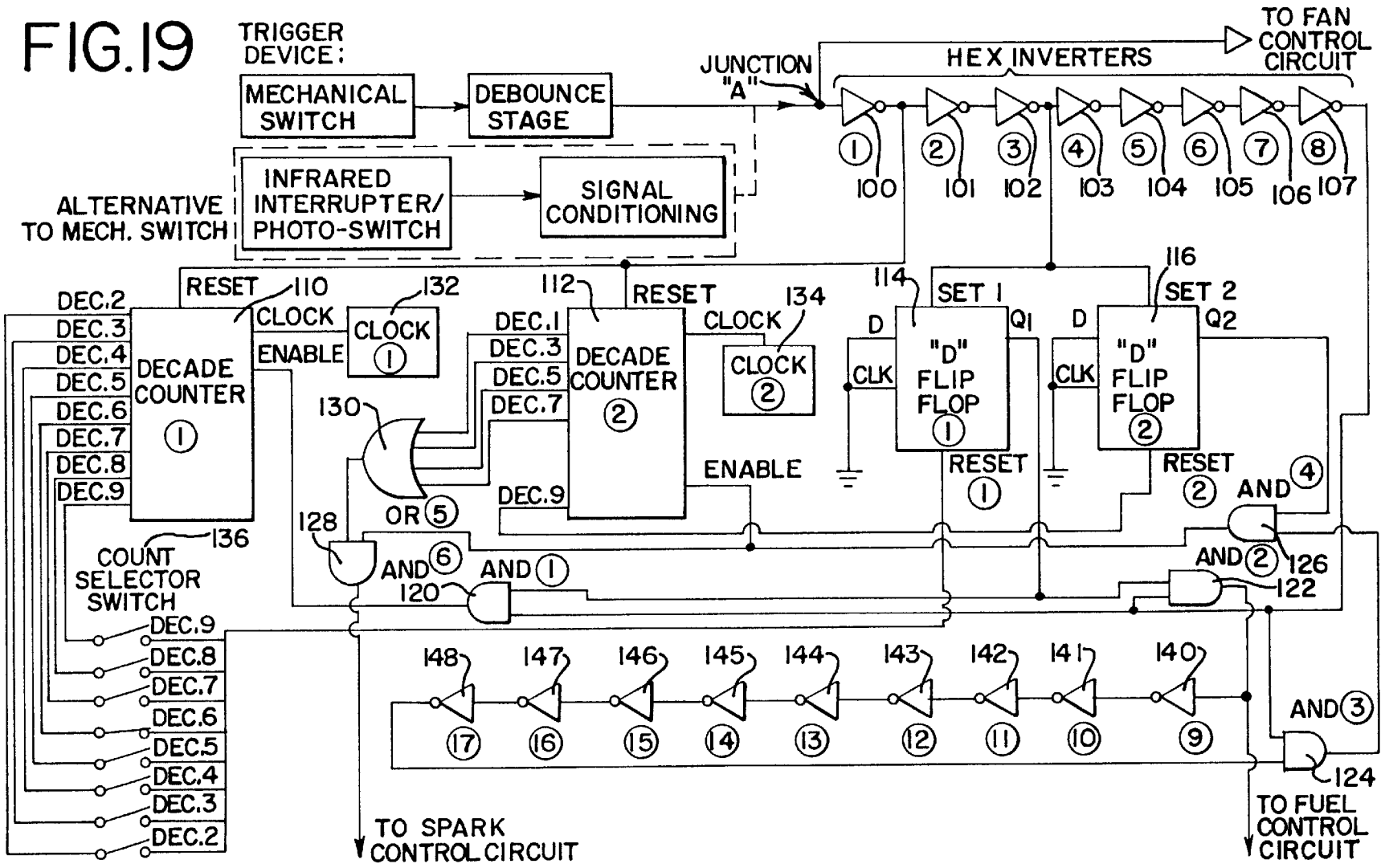
FIG. 19 is a circuit diagram of a digital logic IC circuit for the control circuit of the present invention.

FIG. 18 is a block diagram of the fan control circuit, which is essentially comprised of a fan time-out circuit, an IR isolation stage, a fan driver stage and a fan. Those skilled in the art will recognize the variations set forth in FIG. 18, which could be implemented to the fan control circuit.

Figure 22:
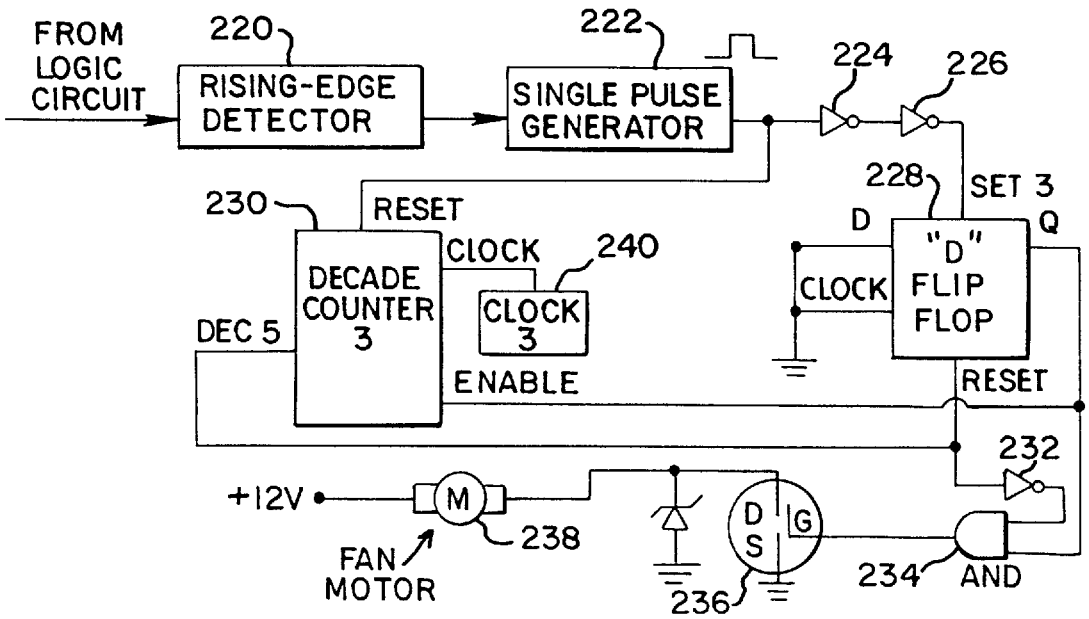
FIG. 22 is a circuit diagram of a fan control circuit for the control circuit of the present invention.

FIG. 22 depicts a circuit diagram of one variation of the fan control circuit. The operation of this variation of the fan control circuit is as follows. A logic-high from the digital logic IC circuit activates rising edge detector 220, which in turn activates single pulse generator 222. Single pulse generator 222 produces an output pulse of a specified width that is independent of the input frequency. This allows the fan control circuit to operate regardless if the triggering device is manually released. The logic-high signal output from single pulse generator 222 passes through hex inverters 224 and 226 and is applied to the "set" input of D flip-flop 228, which sets its output Q at logic-high. The logic-high from single pulse generator 222 is also applied to the "reset" input of decade counter 230, which causes its output at decimal number 5 to be logic-zero. Decimal number 5 passes through hex inverter 232 and is input to AND gate 234 along with signal Q from D flip-flop 228. A logic-high is then produced at the output of AND gate 234, which turns on power MOSFET 236. This turns on fan motor 238, which remains on until the automatic time-out feature of the fan control circuit is initiated. This feature is described below.

After a specified period of time, the output of single pulse generator 222 returns to its quiescent state (logic-zero). This turns off the "reset" signal of decade counter 230. Since its enable input has been previously set at logic-high from signal Q of D flip-flop 228, turning off its reset signal enables decade counter 230 to start counting cycles from clock 240. When decade counter 230 reaches decimal number 5, its respective logic-high signal both resets D flip-flop 228 and causes a logic-zero to be output from AND gate 234, thus turning off the fan motor 238. It should be noted that the running time of the fan motor 238 can be varied simply by using a different decimal count of decade counter 230. Once D flip-flop 228 is reset, a logic-zero is produced at its output Q, which disables decade counter 230 and also keeps the fan motor 238 turned off until another low-to-high transition is detected from the digital logic IC circuit.

Thus, it is seen from the foregoing description that the present invention provides an improved internal combustion gas-powered tool. As used herein, tool is intended to be broadly defined, including but not limited to hand tools such as the described fastener driving tool. While the invention has been described in conjunction with certain specific embodiments, it is evident that many alternatives, modifications, and variations will be apparent to those skilled in the art. Consequently, the following claims are intended to cover all such alternatives, modifications, and variations within the spirit and scope of the invention.

What is claimed is:

1. An internal combustion tool for driving fasteners comprising a cylinder and a piston reciprocally movable within said cylinder;

a combustion chamber defined at one end of said cylinder, said combustion chamber having a first and second opposite ends and a side wall extending therebetween, said piston comprising a portion of said first end of said combustion chamber;

a fastener driver cooperatively associated with said piston;

a magazine for feeding fasteners into registration with said driver;

a fuel flow passageway adapted for communication with a fuel source and opening into said combustion chamber;

a metering valve for controlling the flow of fuel through passageway;

a spark source associated with said combustion chamber for igniting the fuel introduced into said combustion chamber, said spark source comprising a plurality of spark gaps at spaced locations within said combustion chamber;

a valve comprising a portion of said second end of said combustion chamber for opening and closing communication between said combustion chamber and the ambient atmosphere, said valve including at least one aperture;

at least one fan external to said combustion chamber and in fluid communication with said at least one aperture of said valve for inducing a flow of combustion products from said combustion chamber through said at least one aperture.

2. The tool of claim 1 wherein said spark gaps are substantially coplanar and substantially equidistantally spaced about the sidewall of said combustion chamber.

3. The tool of claim 2 wherein said spark gaps are spaced a predetermined distance from the sidewall into the interior of said combustion chamber.

4. The tool of claim 3 wherein said spark gaps is spaced about ⅜ inch or more from the side wall of said combustion chamber.

5. The tool of claim 1 further comprising a control system for discharging at least one of said spark gaps more than once during a given combustion cycle of the tool.

6. The tool of claim 1 wherein said valve further comprises two diametrically opposed apertures and said tool includes a second fan external to said combustion chamber, each of said fans in communication with one of said apertures for inducing a flow of combustion products from one said apertures and a flow of fresh air into the other of said apertures.

7. An internal combustion tool comprising:

(a) a cylinder and a piston reciprocally movable within said cylinder;

(b) a combustion chamber defined at one end of said cylinder;

(c) a spark source for igniting a fuel-air mixture within said combustion chamber, said spark source defining a plurality of spark gaps at spaced locations within said combustion chamber; and (d) a voltage source connected to said spark source for applying a voltage across said spark gaps to cause a plurality of sparks at spaced locations within said combustion chamber to enhance combustion of a fuel-air mixture therewithin.

8. An internal combustion tool in accordance with claim 7 in which said combustion chamber includes a side wall and said spark gaps are spaced from said side wall.

9. An internal combustion tool in accordance with claim 8 in which said side wall is generally cylindrical and said spark gaps are spaced substantially equally around said side wall.

* * * * *